United States Patent [19]

Zidele

[11] Patent Number: 4,860,385

[45] **Date of Patent: * Aug. 29, 1989**

[54] REVERSIBLE SEAMLESS GLOVE

[76] Inventor: Israel Zidele, 1303 Ditmas Ave., Brooklyn, N.Y. 11226

[ * ] Notice: The portion of the term of this patent subsequent to Feb. 29, 2005 has been disclaimed.

[21] Appl. No.: 646,572

[22] Filed: Aug. 31, 1984

[51] Int. Cl.[4] ..... A41D 19/00

[52] U.S. Cl. ..... 2/163; 2/169

[58] Field of Search ..... 2/163, 167, 169, 168, 2/158

[56] References Cited

U.S. PATENT DOCUMENTS

| | | | |
|---|---|---|---|
| 218,625 | 8/1879 | Hall | 2/169 |
| 263,067 | 8/1882 | Slayton et al. | 2/169 |
| 378,834 | 2/1888 | Gunn | 2/169 |
| 580,283 | 4/1897 | Jenner | 2/169 |
| 706,725 | 8/1902 | Comrie | 2/169 |
| 774,489 | 11/1904 | Noll | 2/169 |
| 784,115 | 3/1905 | Morgan | 2/169 |
| 872,137 | 11/1907 | Lauferty | 2/169 |
| 1,183,854 | 5/1916 | Charney | 2/169 |
| 1,549,302 | 8/1925 | Gillian | 2/169 |
| 1,623,019 | 3/1927 | McBride | 2/169 |
| 2,227,586 | 1/1941 | Johnson | 2/169 |
| 2,284,541 | 5/1942 | Sperandeo | 2/169 |
| 2,544,515 | 3/1951 | Tatar | 2/169 |
| 2,632,172 | 3/1953 | O'Hagstrom | 2/169 |
| 4,227,263 | 10/1980 | Zidele | 2/19 |
| 4,365,352 | 12/1982 | Zidele | 2/169 |
| 4,411,026 | 10/1983 | Secter | 2/158 |

FOREIGN PATENT DOCUMENTS

| | | | |
|---|---|---|---|
| 964986 | 2/1950 | France | 2/163 |

*Primary Examiner*—Peter Nerbun

[57] ABSTRACT

A reversible seamless glove made to be worn on either the right or left hand and automatically assuming the proper contour for the respective hand. The glove has a front sheet and a back sheet and either a half stall piece or a gusset. The half stall piece completes the ring finger stall and the gusset completes both the middle finger stall and the ring finger stall. Special stitching including either one thread or two threads is utilized to assist the reversibility of the glove. A specially constructed forchette piece made of minimal size and disposed between the front and back sheets at the outer side of a small finger stall(s) also may be used to assist the reversibility of the glove. Buttons or running stitches and slots may be disposed on the front and back sheets in place of the special stitching or the special forchette to assist the reversibility.

10 Claims, 5 Drawing Sheets

REVERSIBLE SEAMLESS GLOVE

FIELD OF THE INVENTION

The present invention relates to a reversible glove. More particularly, it relates to a reversible glove with minimal seam work on its major plane—usually of sheet covering material—, and that follows and readily assumes the proper contour of either the right or left hand when put within its covering. This is as described in the Dicslosure Document Program No. 110061 filed on July 29, 1982.

BACKGROUND OF THE INVENTION

Gloves of the above mentioned general type are known in the art, e.g., from U.S. Pat. No. 1,844,881 to Bichelani shows a glove low in second constructions. The central finger projections of an outer glove member are sewn together to independent finger members of the opposite facing ply along their reverse u-sides and top-perimeter. These fractional independent members after further attachments that close the edges of their two bases with a palmer portion edge, show visible seams there. An earlier instance of similar light seam work constructions, is U.S. Pat. No. 378,834 to Gunn. Here the outer blank of material is folded over to itself, and with added parts is formed into a glove casing. In addition to the aforementioned phalange based seams, thumb parts joined to ensuing longitudinal edges necessitate more seam work.

Another example is U.S. Pat. No. 4,411,026 to Secter. Similarly here a blank of material is folded over on end in overlying relation to itself, thus forming the glove-covering. Although the back portion, secured to the front portion at perimetral edges, is of larger size thus producing an enclosed spacial area, it is still necessary to secure either an extensive fourchette piece or a few of those fourchettes—defined as slender oblong pieces of sheet material which generally form the side-walls of the four finger hollows. This referenced patent uses ther terms "separators" and "inserts" which when employed to the finger lodging area, makes this "hand covering" roomy enough for fittings. The aforementioned U.S. Pat. No. 1,844,881 to Bichelani also demonstrates this need for further enlargement means. It specifies the addition of two independent finger members as appendages to an already "baggy glove" or one made preliminarily with an inner spacial form.

An earlier U.S. Pat. No. 2,544,515 to Tatar, discloses a similar arrangement of a glove comprising a "blank or trank", that in fold over style superposes like portions on one piece palm and back sections, with the necessary closing seams along edges. Since both front and back sections appear of the same size this glove more surely needs an extensive fourchette piece, or fourchettes—parcelled in smaller pieces similarly to be attached to the finger portions to broaden their inner hollow for fittings. Here also for its outer ply is sewed on an auxiliary, thumb piece, similar to the aforementioned Gunn patent. This appendage to the main blank necessitates additional seam work on the whole of the glove-cover.

Other patented gloves that are reversible, and seamless in character, constituting a uniform even surface on its outer plane are—preformed or dipped gloves, knitted gloves, and gloves of stretchable materials; that generally depart from the use of blanks with finger panel extensions made of the standard flat stock that is described here.

SUMMARY OF THE INVENTION

The present invention relates to improvements in gloves of the prior art.

It is an objective of the present invention to provide a reversible glove that has only one very small seam, laying within the gloves bounded margins, defining its major planes. Specifically it is where the natural finger base indentation is, and is the same or less in length as a central finger stall—width or base—dimension.

It is another objective of the present invention to provide a reversible glove with no fourchette.

It is a feature of the present invention to provide a reversible glove that follows and assumes the proper hand contour whether fitted to the right or left hand, and thus with its near seamless construction achieves a peak of comfort, and give, much more commodiously than an ordinary glove.

It is yet another objective of the present invention to provide a reversible glove that is easy to manufacture, inexpensive to produce, and affords a stronger glove by minimizing the number of composite parts and required seams.

It is still another objective of the present invention to provide a reversible glove that has a side strip. The side strip can be stamped or cut from a single blank, and when properly sewn in place with conventional stitching would afford reversibility of the glove.

A general objective here shows new and useful improvements to my older U.S. Pat. Nos. 4,227,263; 4,365,352; 4,366,580; D-264,517, that relate to the glove art. A number of those gloves that are stamped from a flat pattern blank, as one or two solid pieces, to form the front and back—glove composition, can be made especially adaptable towards working gloves, and dress gloves, and may be applied to all gloves of suitable material. This is enabled as shown by the drawings here of new constructions and simplification of the reversible means, as will be hereinafter more fully set forth.

Two prior art forms, and a construction in my previous patents, (with new structural plans—put forth elsewhere in this specification), have referenced views in the accompanying drawings for convenience, in more readily understanding novel constructions, here.

DETAILED DESCRIPTION OF THE PREFERRED EMBDIMENTS

Figure 1:
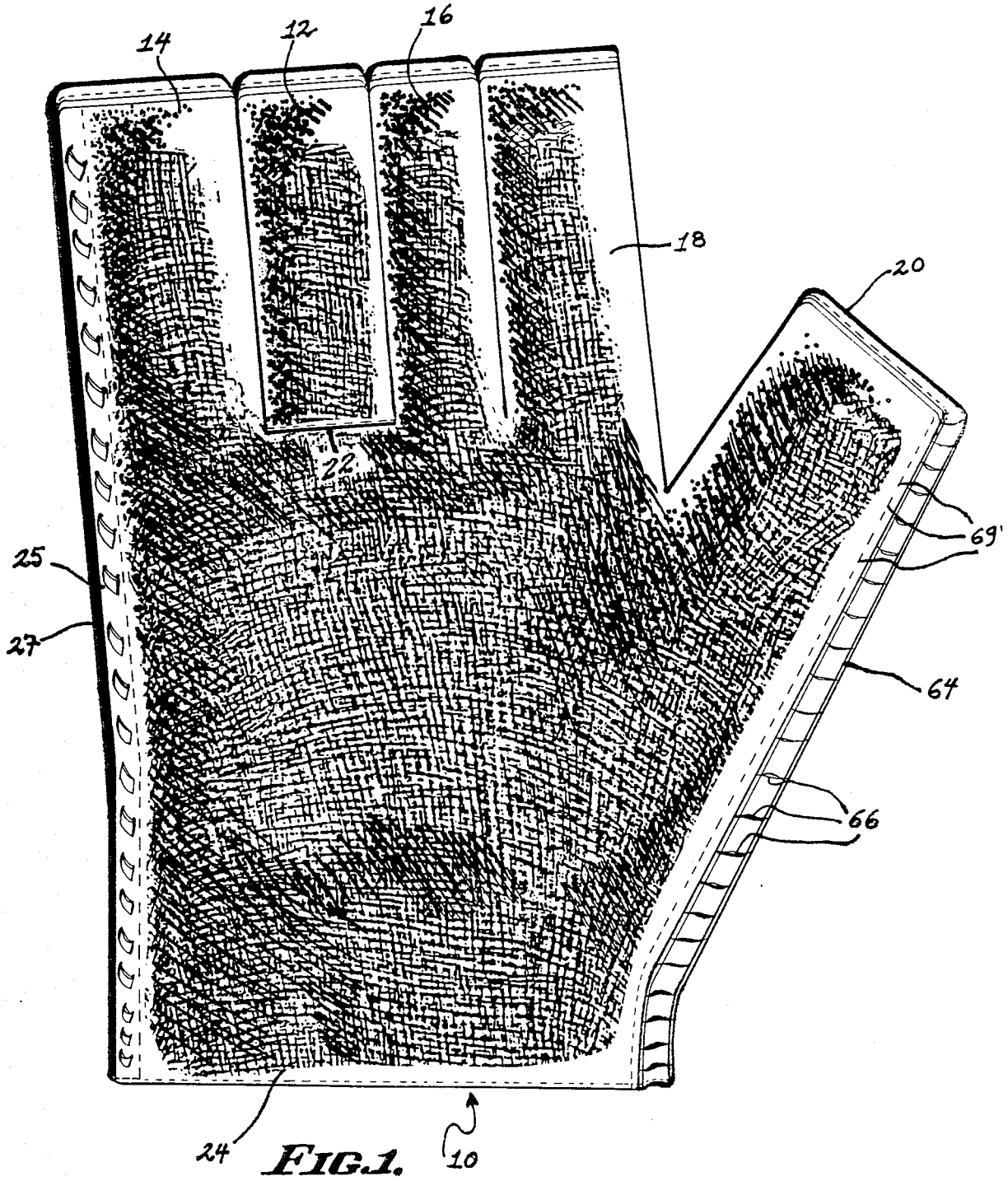
FIG. 1 is a perspective view of the reversible glove of the present invention taken from the back panel.

Referring now to FIG. 1, the reversible glove of the present invention is shown generally at 10 having full stall projections 14, 16, 18, 20–portions that branch out from, and being one solid piece with their related palmer or back panels, and a stall-portion 12 with a fractional independent piece partially making up this composite, as one of its two facades that are sewn together in place, thus forming a compartment with an opening for the finger to enter. This stall portion 12 has a base seam 22. An alternate embodiment has the stall-portion 16 as the aforementioned sectional stall, and the stall portion 12 as the full projection.

Figure 2A:
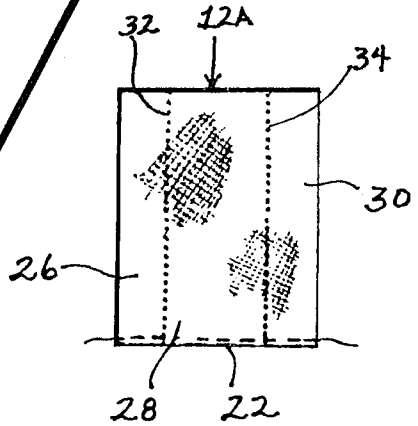
FIG. 2A shows the complementary finger stall member as a flat pattern.
Figure 2:
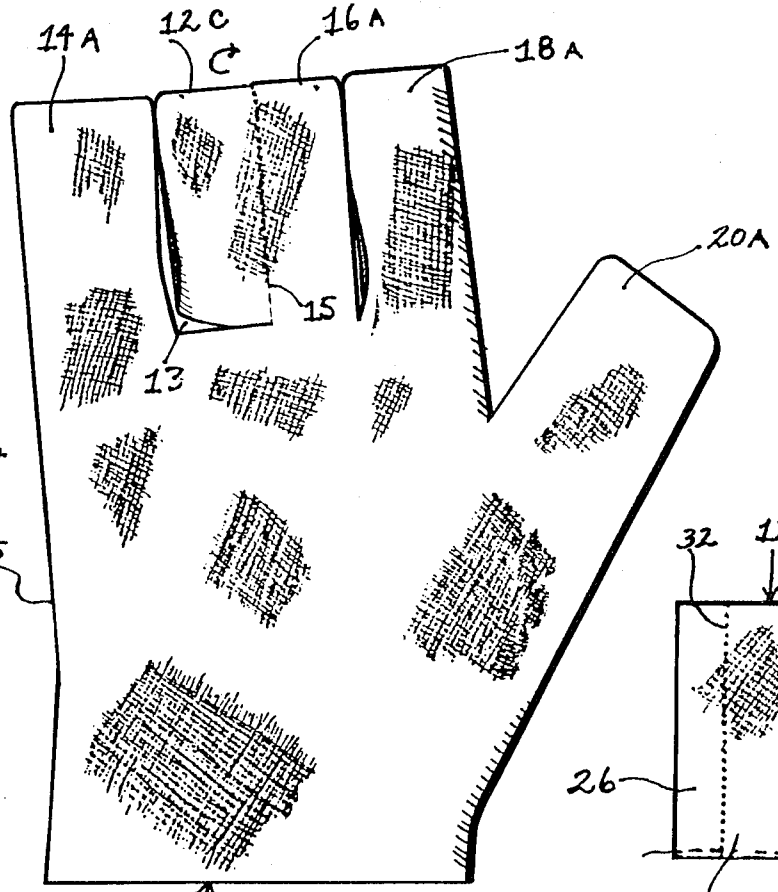
FIG. 2 is a plan view of the back panel of the reversible glove according to FIG. 1

FIG. 2 shows, a unitary back panel 24 of the reversible glove, and FIG. 2A shows a detached, unitary stall member 12*a*. The back panel 24 has full stall projections 14*a*, 16*a*, 18*a*, and 20*a* and a space 13 for placing the unitary stall member 12*a*, which consists of three integral portions 26, 28, 30; each being bendable about dotted lines 32 and 34 respectively. The back panel 24 also contains a flap 12C which is integral laterally with the full stall projection 16*a* and is bendable generally at dotted line 15. The unitary stall member 12*a* with its bendable side portions 26 and 30, is placed over the full stall projection 12*b* of the front panel 36, thereinafter being sewn together about their peripheries, where their sides and top meet, the end portions 26 and 30 having been turned inwardly to form the side walls of stall 12. The base 22, of this added stall piece, generally between the dotted lines 32 and 34, is sewn to the back panel 24 at their adjoining edges. The bases of the inwardly turned side portions 26 and 30, one of which is shown at 19, FIG. 21, are each sewn to the adjoining base of their respective adjacent stalls 14 and 16.

Figure 4:
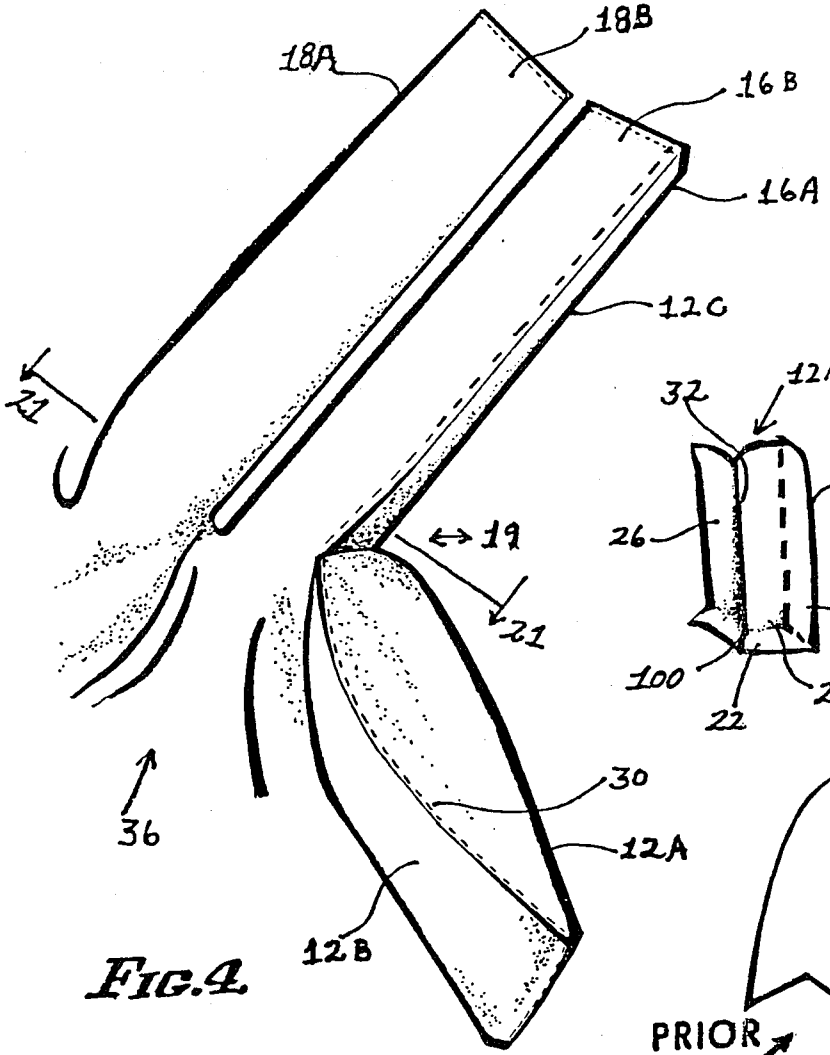
FIG. 4 is a fragmented perspective view of the assembled reversible glove, according to FIG. 3 and showing the complementary finger stall member sewn in place.

This forms the full stall 12, seen in FIG. 4 where the sides of the two adjacent stalls 16 and 12, lay in a more open position disclosing a junction base 19.

Figure 3:
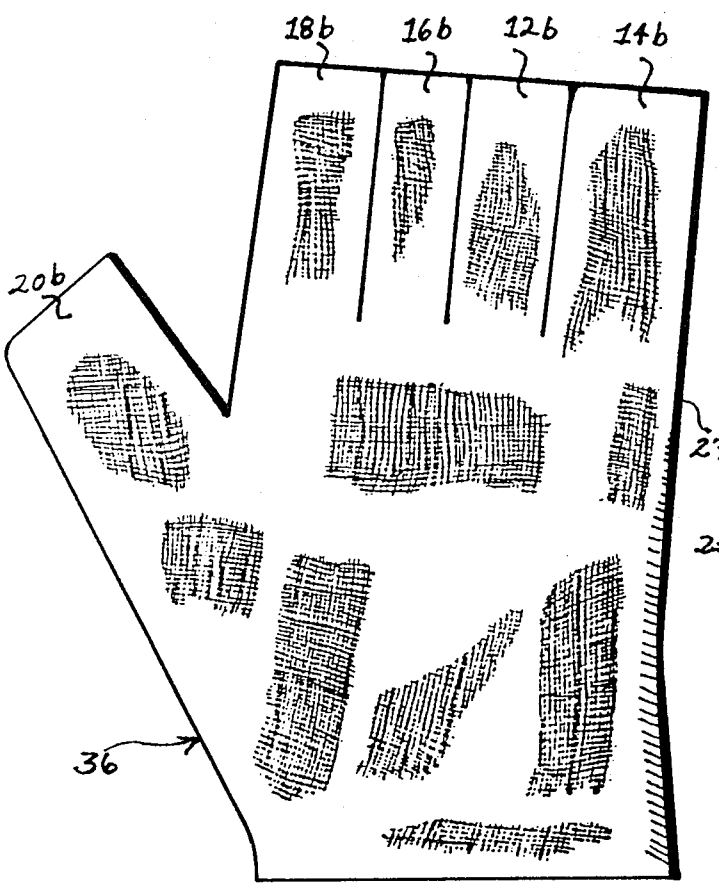
FIG. 3 is a plan view of the palm side of the reversible glove according to FIG. 1.

FIG. 3, shows a front panel 36 of the reversible glove. The front panel 36 has all full stall projections 20*b*, 18*b*, 16*b*, 12*b*, and 14*b* and is completely seamless. In assembly the back panel 24 is placed over the front panel 36, so that the respective stall projections 20*a* and 20*b*, 18*a* and 18*b* and 14*a* and 14*b* are located correspondingly on top of each other, and are sewn together about their peripheries. The remaining flap 12C of the back panel 24 is turned toward the fully projecting stall 16*b* of the front panel 36, to which it is sewn, FIG. 4. This with other perimetrical closing of seams—at the other side and top—when applied to this finger hollow construction, the full stall 16 is formed. Lateral areas 25 and 27 may be secured directly by conventional glove closing stitching such as Lapseam, In-seam, P.X.M., to achieve a conventional glove construction. If not sewn together directly areas 25 and 27 can be united by sewing in place a fourchette, if desirable. The application here of the reversible glove means—by attaching a special fourchette strip—is another alternative as described hereafter.

Figure 5:
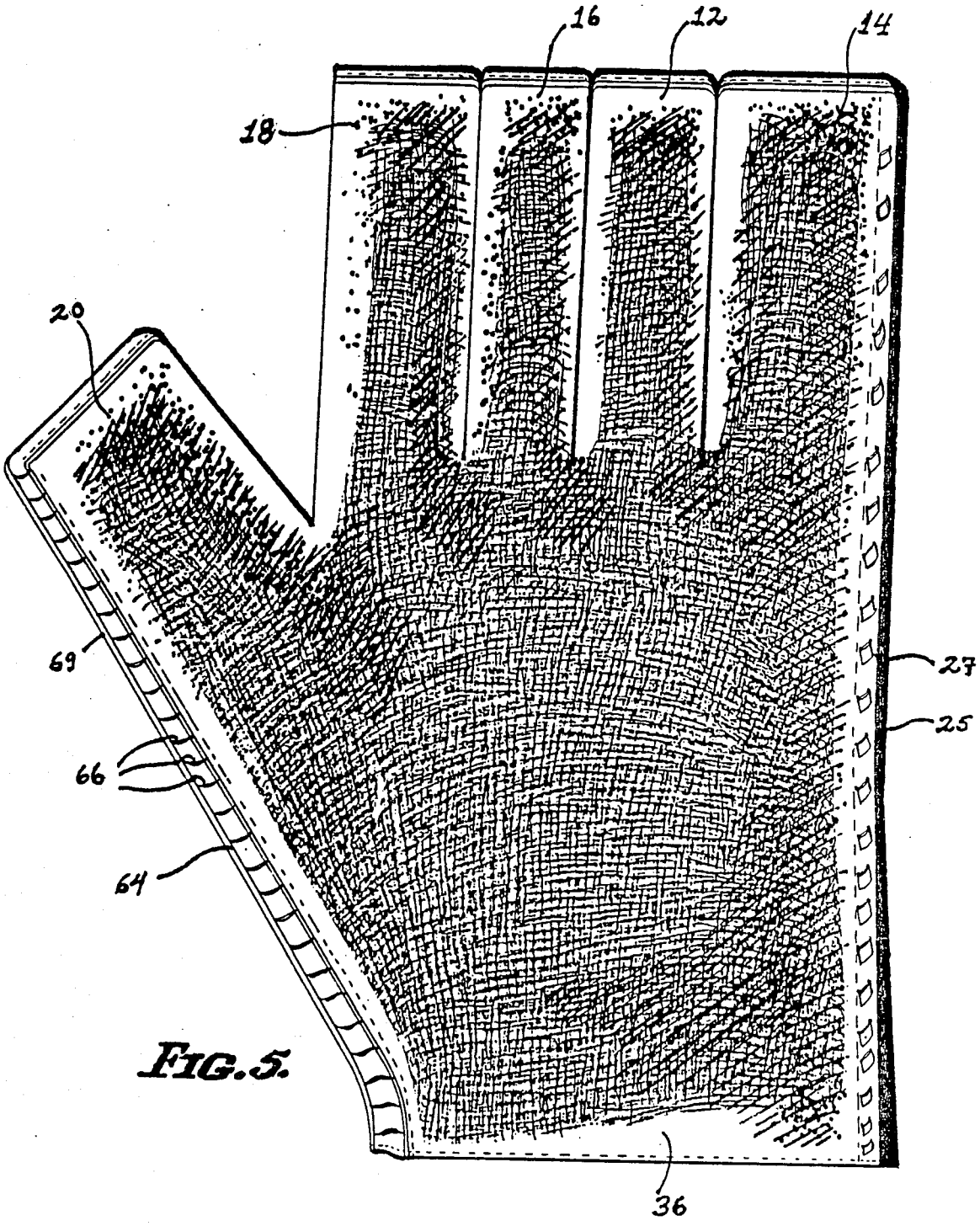
FIG. 5 is a perspective view of the reversible glove of the present invention taken from the palm side.

FIG. 5 shows a palm view, relative to FIG. 1, of the completed reversible glove 10.

Figure 6:
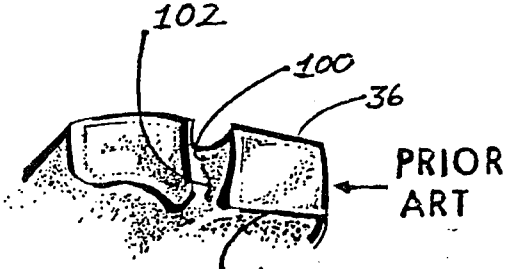
FIG. 6 is a fragmented perspective view of two central glove-stall portions—discernable at FIG. 4, and brought into clearer focus here from an elevational range in the direction of the arrows at cutaway line 21—21 of the FIG. 4, clarifying site positions of their phalanes and juncture bases. These segmented stall-forms/shapes-denoted by th circumscribed outline of the stall "stumps" (imaginary cutaway view), as differentiated from the structural make up in plan of these stalls, go back in time to old and known state of the art forms.
Figure 7:
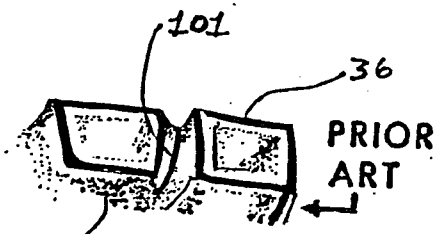
FIG. 7 is an alternate mode in fragmented perspective view to FIG. 6, and goes far back in time to old and outmoded state of the art forms. This is illustrated to show the differential in form/shape improvements of FIG. 6, described above and in the accompanying figures, illustrating its structural make up in plan.
Figure 8:
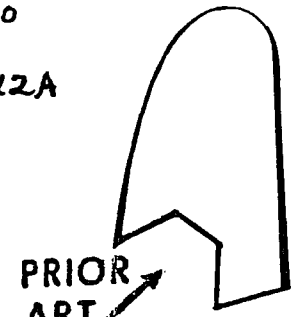
FIG. 8 illustrates in plan view a complimentary finger stall member of the prior art, according to FIGS. 1 and 2.
Figure 9:
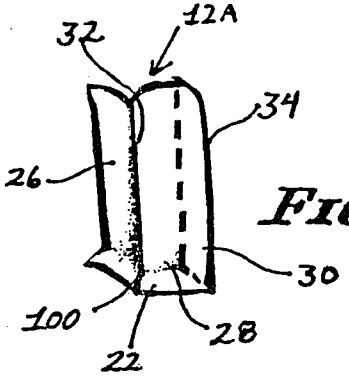
FIG. 9 illustrates in plan view a complimentary finger stall member, similar to the one shown in FIG. 2, however with its lateral sides turned at oblique angles to the front plane of the glove. This fractional stall piece, in substance a plain geometric design, is easier to tailor for tthe glove and manufacture than the older illustrated pattern of FIG. 24.

Gloves sold in retail outlets everywhere have offsetting sewn positions at their finger base junctures, thus inducing there a nicety of fit and ease on the hand in glove. This is shown at FIG. 6 at 100,—being other than the right angle (than of FIG. 7 at 101, seen at 90 degrees) to the front plane of sheet covering material, 36. It is discernable from FIG. 2, that flap 12C is bendable along a dotted line 15, which may be located more to the right or left, so that when the flap is turned for attachment it lays either at an oblique or acute angle, other than 90 degrees. This is shown at 100 in its broad general direction, it being often an irregular or curved line 102. Thereby this central flap construction also shown at 19 of FIG. 4, retains this grooved formation laying in the knuckle area between each of the four close grouped finger stalls, and that is on glove apparel worldwide.

Figure 13:
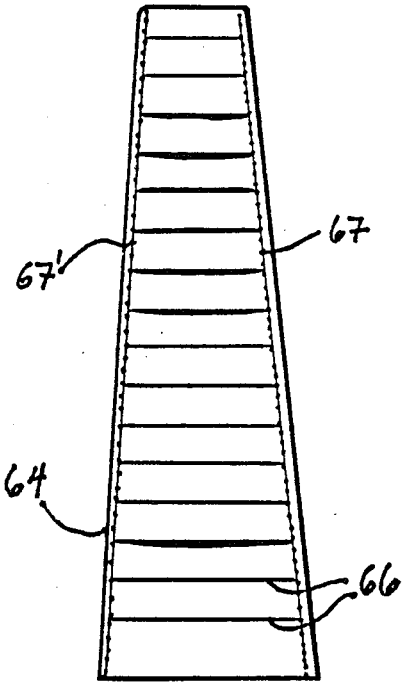
FIG. 13 is a plan view of a modified side strip before application to the glove, as a reversible means.

A modified side strip 64 shown as a unitary blank of material, with die cut or stamped out lateral divisions, 66 of FIG. 13, when applied to the glove, is used as a means to facilitate its reversibility by the shifting of the glove's contours for the other hand's configuration.

The aforementioned lateral divisions, are shown here, specifically, as transverse cuts 66 along the length of the side strip 64 which is seen here in its flat pattern stage. This flat piece 64 is sewn in the glove outer sheet margins at 69 and 69′; between the back sheet 24 of FIG. 2 and the front sheet 36 of FIG. 3. This is exemplified by FIGS. 1 and 5, along a side length 69 and 69′. The same fourchette side strip 64 is then cut at the dotted lines 67 and 67′ which then yields a reversible arrangement, illustrated in FIG. 10 as a flat layout from an inside breakaway view. This allows for the interplay between the palm and back panels thus keeping the proper glove contours that follow on each hand. This form eases manufacturing by not surpassing here the number of required sewings on conventional gloves and by using standard machine stitching.

Old and well known tailoring methods may be adapted to the new constructions here. An instance would be in outlining—lateral side strip 64 for its pattern stage, FIG. 13, and to design it with suitable dimensions to be accommodating to the form of either hand. It would be helpful to put the glove in its full contour positions for the right and left hands, and use basting-s—temporary stitchings that can be loosened, tightened or pulled free, to hold the glove outer plies together, with their lateral edges in place. Thus each gradation of thongs comprising it, FIG. 14, may be accurately set for a size, thereby determining the overall shape of the aforementioned side strip 64.

Figure 12:
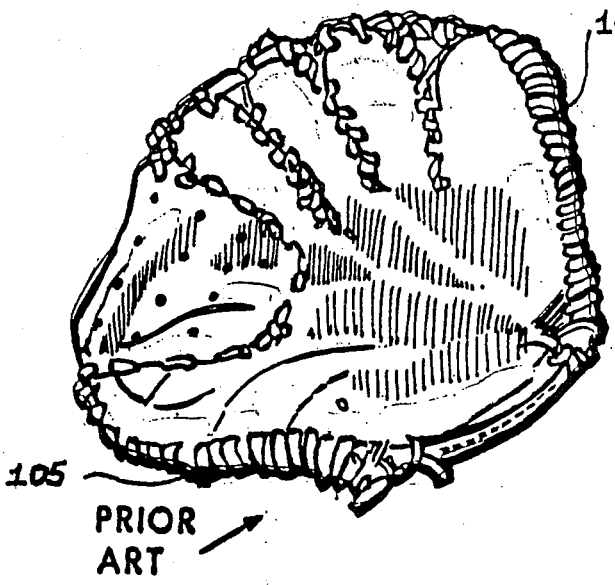
FIG. 12 illustrates a palm side view of a sporting glove, more specifically the reversible means applied to it; and whose construction is in my previous U.S. Pat. Nos. 4,227,263 and 4,366,580.
Figure 11:
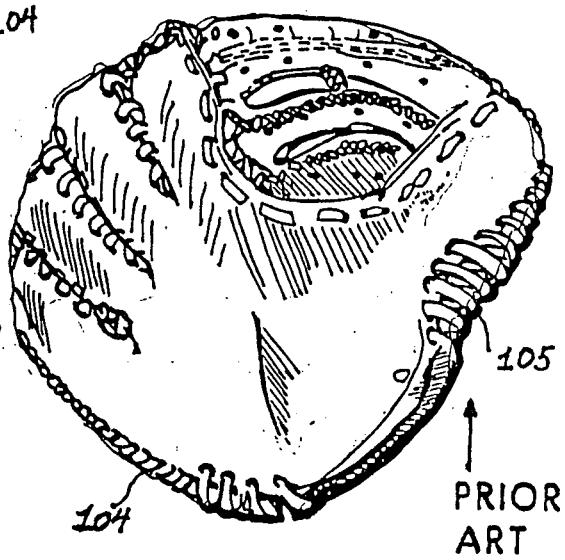
FIG. 11 illustrates a back view of the reversible sporting glove in FIG. 22.

Similarly, to baste in the manufacture of the gloves with a reversible means of my previous patents (referenced by number here earlier), FIGS. 11 and 12, would also make each gradation of the series of over-stitchings described there 104, 105 that bind the sides of the glove together, correct in width for a proper size. The improvement here of the aforementioned reversible means—the fourchette side strip, 64 of FIG. 13—, lies in the incorporation of all its thong gradations into one die cut or stamped out piece—which is easier to make for a pattern size dimensions.

Figure 10:
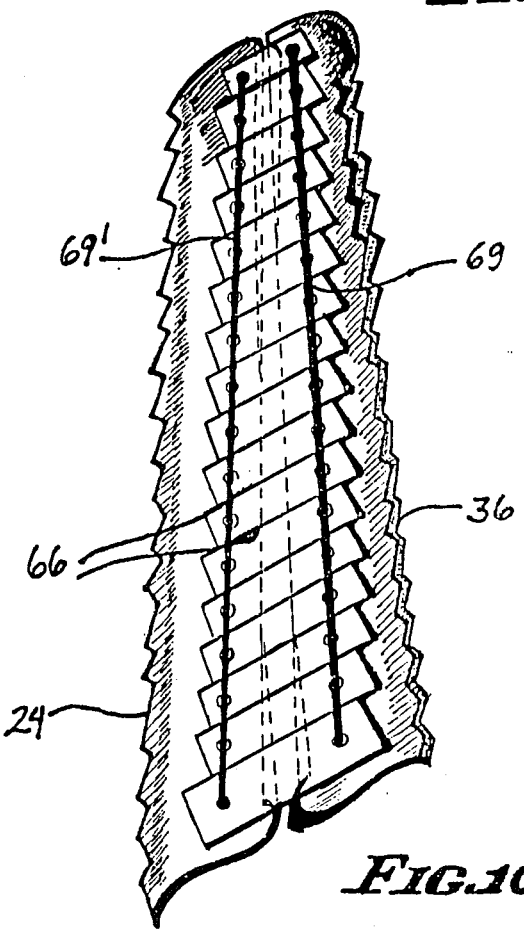
FIG. 10 is a plan view of the modified side strip after application and showing an undulating motion of its ladder formation to its utmost degree, enabling the reversing and shifting of the glove contours for the other hands configuration.

A further improvement here is in the use of rapid manufacturing processes as machine sewings of running stitches, to fasten the movable thong gradations, FIG. 10, to the glove during their previous pattern stage, FIG. 13. In my referred to older patents, FIGS. 11 and 12, this reversible means is hand made, each stitch being threaded by hand crafted labor, thus forming the row of "whipstitchings" shown there 104, 105 as a ladder like formation of over-castings. It is also called appropriately "handwhipped." Although some ultra modern machine methods of manufacturing may be adapted toward those formations, nevertheless, the reversible means here, FIGS. 13 and 14—using standard sewing machines and made in a uniform, flat, and modern style, if applied, is more preeminently disposed toward mass produced gloves, and other apparel—specifically clothes and shoes, that allow for a give and change as well in their forms.

In the old state of the art (references given) numerous patented glove constructions going back to the nineteenth century have the dies in the press-cast in the form of the palm and back panels of the glove—alongside each other, for stamp cutting both panels into a single trank. Thereafter during individual assembly, each of the glove tranks (blanks of cut out sheet material) gets a mid-fold which brings into alignment and superimposition like portions; and with appendages in place, the opposing facades are further secured to one another with sewings at the appropriate edges to be closed up. The customary finishing operations produce the glove. Today, both of these main pieces of the glove body are cut out on top of each other—in the same batch, separately; therefore the latter more practical way for common use is represented here in full description with drawings.

I claim:

1. A reversible right to left hand glove or vice versa comprising a front and a back panel; said front panel consisting of a unitary piece of material cut such that there are five finger stall pieces including the thumb, index middle, ring, and little finger; the back panel consisting of a unitary piece of material cut such that there are thumb, index and little finger stall pieces, the middle finger stall piece being cut such that it is substantially extending over the ring finger and forming a flap being free at its base from the material of the back panel; the front and the back panel being superimposed and sewn together at all peripheries except the ring finger stall piece of the front panel, with the back panel's extending flap being sewn to the middle finger stall piece of the front panel leaving a material gap confronting the ring finger stall piece of the front panel, a separate piece of material representing a ring finger stall piece of the back panel being sewn to the ring finger stall piece of the front panel at their peripheries and at its base to the back panel thereby representing the only seam within the periphery of the glove and five finger stalls.

2. A reversible right to left hand glove or vice versa comprising a front and back panel; said front panel consisting of a unitary piece of material cut such that there are five finger stall pieces including the thumb, index, middle, ring and little finger; the back panel consisting of a unitary piece of material cut such that there are thumb, index and little finger stall pieces, the ring finger stall piece being cut such that it is substantially extending over the middle finger and forming a flap being free at its base from the material of the back panel; the front and the back panel being superimposed and sewn together at all peripheries except the middle finger stall piece of the front panel, with the back panel's extending flap being sewn to the ring finger stall piece of the front panel leaving a material gap confronting the middle finger stall piece of the front panel, a separate piece of material representing a middle finger stall piece of the back panel being sewn to the middle finger stall piece of the front panel at their peripheries and at its base to the back panel thereby representing the only seam within the periphery of the glove and five finger stalls.

3. The glove as defined in claim 1 or 2 wherein said stall piece and/or its extension is substantially rectangularly shaped.

4. The glove as defined in claim 1 or 2 wherein said stall piece and/or its extension is substantially shaped, partially or fully, as an oblong conic section.

5. The glove as defined in claim 1 or 2 wherein said separate stall piece is substantially rectangularly shaped, when laid out flat.

6. The glove as defined in claim 1 or 2 wherein said separate stall piece is substantially shaped, partially or fully, as an oblong conic section.

7. The glove, as defined in claim 1 or 2 wherein there are grooved juncture bases disposed at angles that are oblique to the front plane of the glove, allowing the fingers to articulate forward with their wider base block form of the hand, with more roominess in the glove.

8. The glove as defined in claim 1 or 2 further comprising means to assist in reversing the glove from right hand use to left hand use, and vice versa, and wherein said assist means is a fourchette piece sewn between the front and back panels of the reversible glove.

9. The glove as defined in claim 8 wherein said fourchette piece is a strip of material sewn at its edges between the peripheries of said front and back panels or selected portions thereof.

10. The glove as defined in claim 8 or 9 wherein said fourchette piece is formed with individual straps; that are sewn together by two strands to form a ladder like formation that shifts by undulating movements of the said straps, effecting other motions related to glove dynamics during reversing.

* * * * *